United States Patent [19]

Fisher

[11] 3,994,036

[45] Nov. 30, 1976

[54] FLEXIBLE STAGING PLATFORM AND THE LIKE

[76] Inventor: Sidney L. Fisher, 3115 Mt. View Drive, Renton, Wash. 98055

[22] Filed: Mar. 26, 1976

[21] Appl. No.: 670,636

Related U.S. Application Data

[63] Continuation of Ser. No. 289,796, Sept. 18, 1972, abandoned.

[52] U.S. Cl. ..... 14/10; 182/222; 52/640

[51] Int. Cl.[2] ..... E01D 15/00

[58] Field of Search ..... 182/222, 223, 218, 142; 14/4, 9, 10, 13, 14; 52/640, 641, 643

[56] References Cited

UNITED STATES PATENTS

| | | | |
|---|---|---|---|
| 1,122,504 | 12/1914 | Huebner | 14/9 |
| 1,163,641 | 12/1915 | Cummings | 52/640 |
| 1,174,931 | 3/1916 | Furry | 52/640 |
| 1,360,509 | 11/1920 | Eleman | 14/9 X |
| 2,629,532 | 2/1953 | Tupper | 182/218 |
| 2,732,118 | 1/1956 | Reinhardt | 182/218 |
| 2,916,102 | 12/1959 | Reinhardt | 182/143 |

*Primary Examiner*—Nile C. Byers, Jr.
*Attorney, Agent, or Firm*—Graybeal, Barnard & Uhlir

[57] ABSTRACT

A platform mountable to extend between a pair of vertically movable stagings to provide a vertically movable elongated staging. The staging platform is composed of a plurality of like configured bridge sections vertically pivotably connected end to end and maintained in horizontal alignment between the spaced stagings and stretched taut beneath the bridge sections to prevent the staging platform from sagging while allowing the platform to bend upwardly. The pivotal connecting means between the bridge sections being spaced laterally at deck level of the platform and thus having substantial capability for flexing in response to longitudinal twisting forces exerted thereon.

5 Claims, 8 Drawing Figures

Fig. 1.
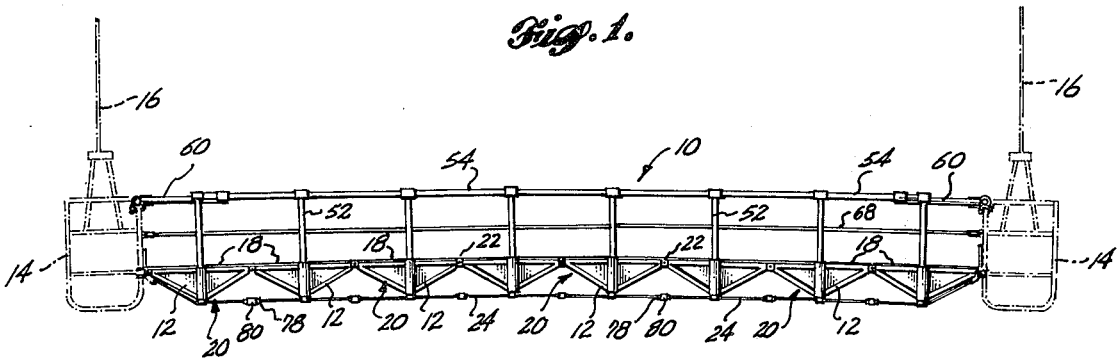
Fig. 2.
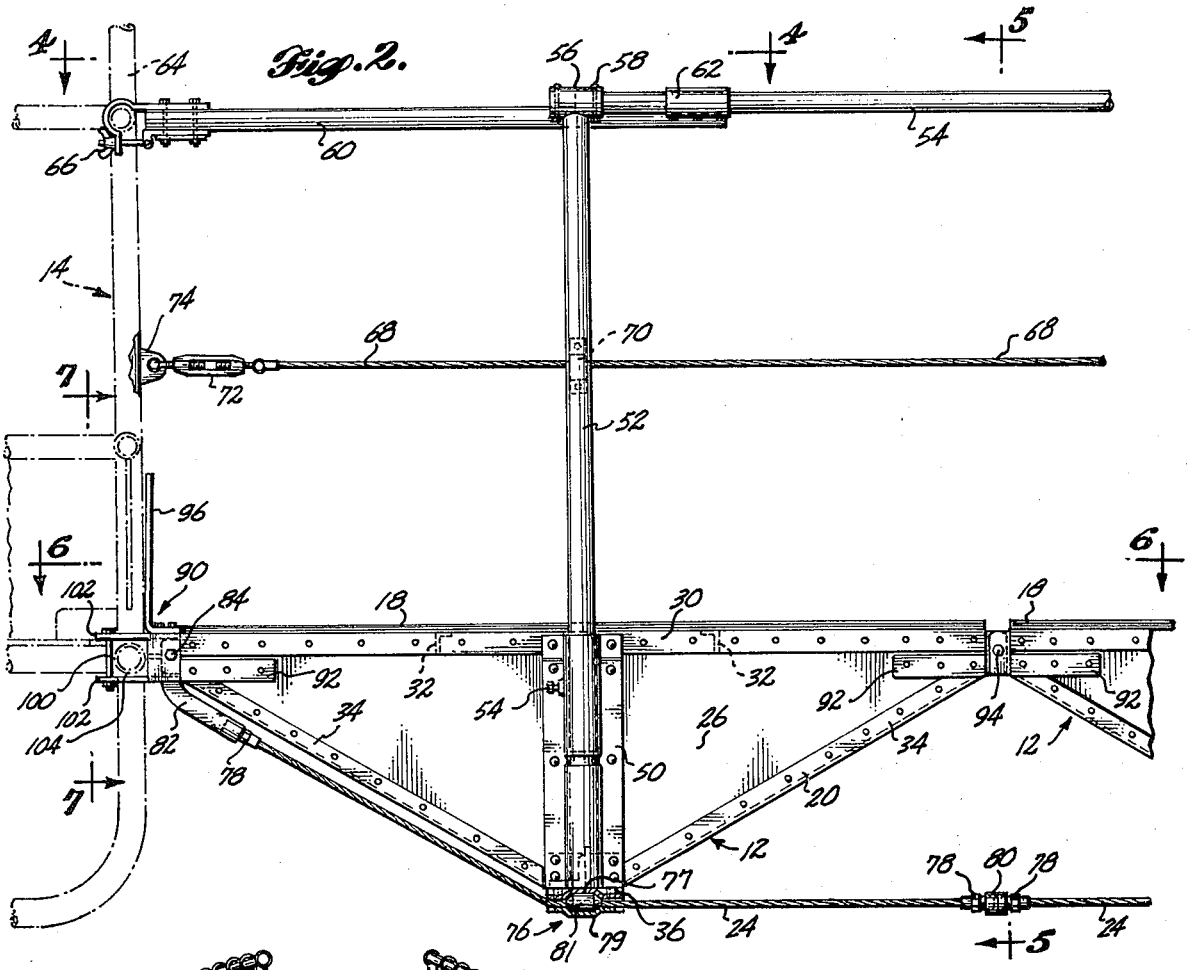
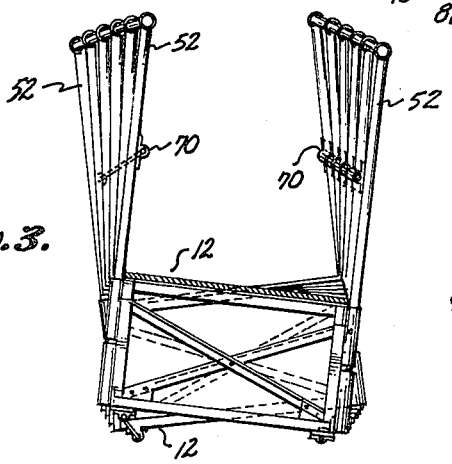
Fig. 3.
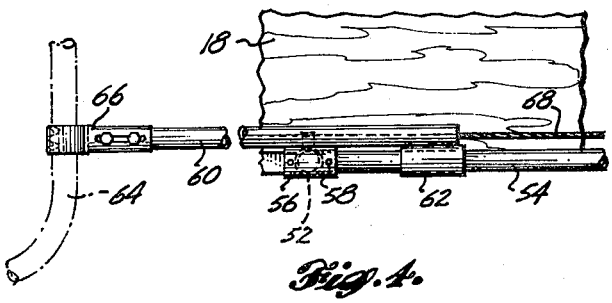
Fig. 4.

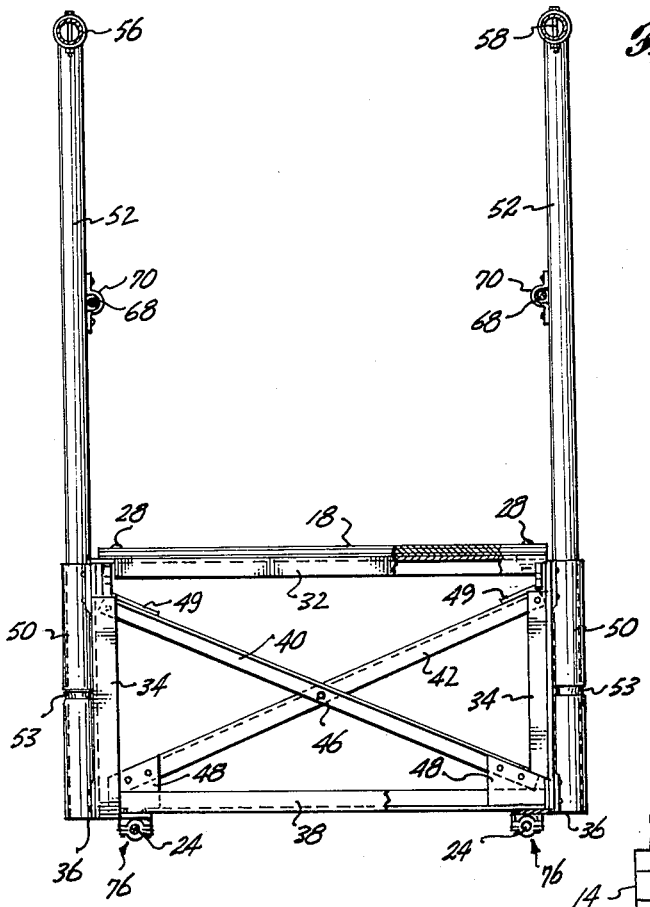
Fig. 5.
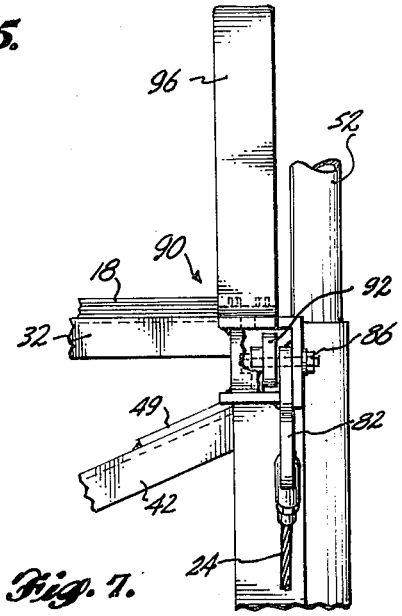
Fig. 7.
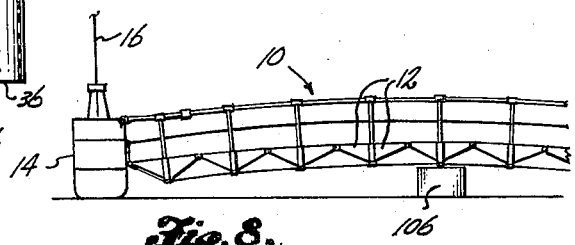
Fig. 8.
Fig. 6.
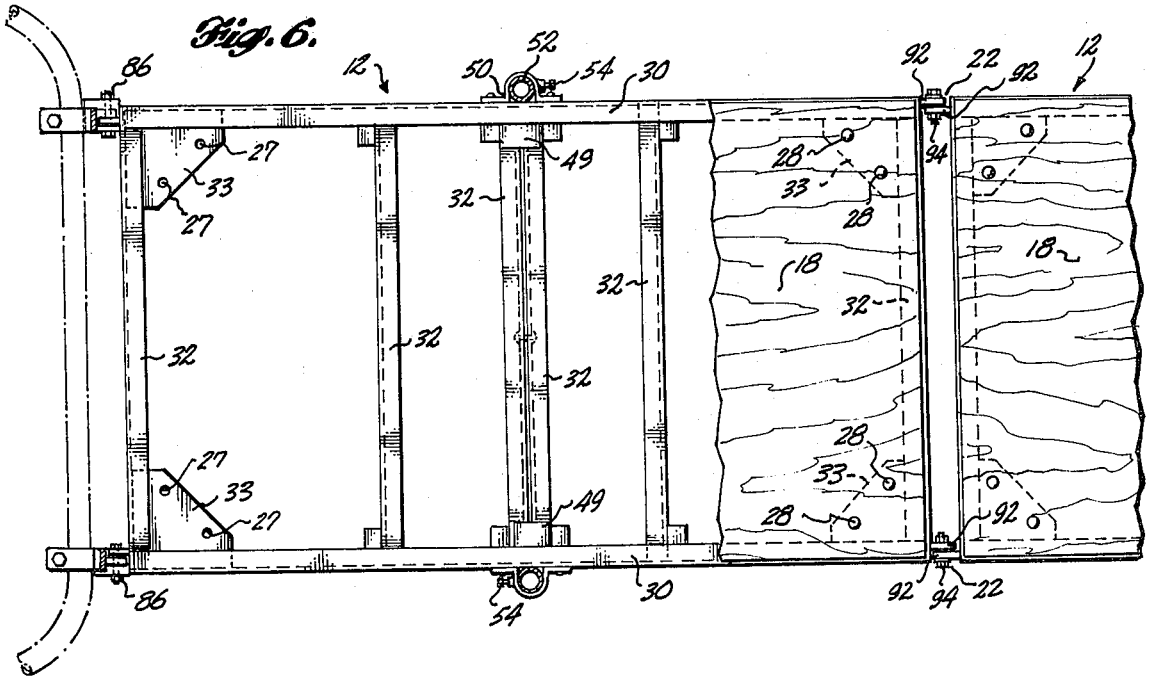

FLEXIBLE STAGING PLATFORM AND THE LIKE

CROSS-REFERENCE TO RELATED APPLICATION

This is a continuation of my copending application Ser. No. 289,796, filed Sept. 18, 1972, now abandoned and entitled FLEXIBLE STAGING PLATFORM AND THE LIKE.

BACKGROUND OF THE INVENTION

1. Field of the Invention

This invention relates, in general, to a modular bridge structure and more particularly, to a modular type platform mountable like a bridge between vertically movable suspended stagings wherein like configured bridge units are interconnected end to end to form a flexible staging platform.

2. Description of the Prior Art

In the past, staging platforms have usually been constructed as a single rigid longitudinally extending unit supported near its ends or also at spaced points between its ends from hanging cables. U.S. Pat. No. 2,916,102 discloses a pair of one piece rigid bridge structures pivotally connected end to end, the central pivot point necessitating use of a central support cable to prevent the staging platform from sagging at its center. U.S. Pat. No. 2,041,031 also discloses a joint for interconnecting two scaffolds end to end, the interconnected scaffolds again being supported both centrally and at its ends by vertically extending cables.

The old U.S. Pat. No. 175,095 discloses a painter's scaffold having a deck or platform which is stiffened by brace rods which are stated to be of considerable strength and which extend longitudinally beneath the platform and are connected thereto near its ends.

Staging platforms which are incrementally length adjustable by extending sliding deck pieces longitudinally from beneath the ends of a central deck structure are also known as are platforms whose lengths may be varied by the addition or substraction of entire platform sections which are rigidly clamped together. Platforms of these types are presently offered for sale by Spider Staging, Inc. of Renton, Washington.

In the past, it has been thought necessary for safety reasons to construct staging platforms to be structurally rigid, rigidity generally having been equated with strength. In use, however, these rigidly constructed platforms are relatively easily damaged such as by being inadvertently lowered onto an obstacle causing a portion of the platform substructure to be bent and weakened, or if the obstacle happens to be located near the longitudinal center of the platform, causing the entire platform to be bowed thereover thereby unduly stressing the entire platform structure. Further, known rigid platform structures are particularly unsuited to withstand longitudinal twisting forces or torsional forces such as those encountered when a corner of such a platform catches on an outwardly projecting portion of a building during raising or lowering of a platform, or when a platform is lowered onto the ground with an obstacle under one corner of the platform.

Further, replacement of bent or broken structural members of known types of staging platforms often necessitates the platform being returned to the manufacturing plant causing the platform to be out of service for a substantial period, often just when it is most needed at a construction site or the like.

BREIF SUMMARY OF THE INVENTION

The instant invention relates to a novel staging platform formed by the flexible interconnection of a plurality of like bridge structures, the interconnection of the bridge structures being such that the platform need be supported only at its longitudinal ends. Each bridge section includes a top deck portion and a deck supporting substructure. Adjacent bridge sections are pivotally pinned together at their lateral edges solely at deck level such that the bridge sections may pivot vertically with respect to each other, and further, such that two interconnected adjacent bridge sections have a substantial torsional flexibility without permanent deformation. Cables are connected to the distal ends of the staging platform and are stretched taut beneath the substructures of the bridge sections to maintain the decks of the interconnected bridge sections horizontally aligned. In one embodiment, each bridge structure includes a pair of cables spacedly clamped to the central portion of the substructure and extending longitudinally a distance substantially equal to the length of the bridge section. Connecting means are provided to join the ends of the cables mounted on adjacent pinned bridge sections. This construction allows the length of the platform to be quickly and easily varied by the addition or removal of entire bridge sections. The cables running beneath the pivotally connected bridge sections, while preventing the bridge from sagging downwardly, allow the bridge to fold upwardly without permanent deformation.

It is an object of the present invention, therefore, to provide a chain-like staging platform comprising a plurality of like configured bridge units easily interconnectable end to end.

Another object of the present invention is to provide an end supported staging platform which is flexible in the vertically upward direction.

Still another object is to provide a staging platform which is torsionally flexible.

One more object is to provide a staging platform comprising a plurality of interconnected bridge sections pivotally pinned together solely in a single plane and relatively flexible interconnected by longitudinal cables stretched taut therebelow.

Still another object is to provide a flexible, multisection staging platform which needs to be supported by vertical cables solely at its longitudinal ends.

Another object is to provide a staging platform or walkway bridge structure which is inexpensive to construct, light in weight and yet extremely strong.

Other and additional advantages will be apparent from the following description taken in conjunction with the accompanying drawings.

BRIEF DESCRIPTION OF THE DRAWINGS

FIG. 1 is a side elevation view of a staging platform typifying the instant invention mounted between a pair of vertically movable stagings.

FIG. 2 is an enlarged partial side elevation view of the staging platform of FIG. 1 showing the interconnection between the staging platform and one of the vertically movable stagings.

FIG. 3 is a schematic end view of a staging platform typifying the instant invention illustrating the torsional flexibility of the platform.

FIG. 4 is a sectional view taken along lines 4—4 in FIG. 2.

FIG. 5 is a partial sectional view taken along lines 5—5 in FIG. 2.

FIG. 6 is a partial sectional view taken along lines 6—6 in FIG. 2.

FIG. 7 is a partial sectional view taken along lines 7—7 in FIG. 2.

FIG. 8 is a partial schematic view illustrating the vertically upward flexibility of a typical staging platform made according to the instant invention.

DETAILED DESCRIPTION OF THE INVENTION

Referring initially to FIG. 1, a typical modular staging platform 10 made according to the instant invention comprising eight like configured bridge modules or sections 12 interconnected end to end is disclosed supported at its ends by means of conventional vertically movable stagings 14 hung from cables 16. Each of the bridge sections includes a deck portion 18 supported by a substructure 20. The individual bridge sections are pinned together at deck level at laterally spaced points 22 such that the bridge sections may pivot vertically with respect to each other, and the bridge sections are further interconnected by means of flexible cable sections 24 extending tautly between the ends of the staging platform to prevent the bridge sections from sagging downwardly about the pivot points 22.

Referring additionally to FIGS. 2, 5 and 6, it will be seen that in the illustrated embodiment each bridge section 12 may include a frame constructed of support braces of L-shaped cross section mounting triangular metal side support plates 26 and top deck frame 18 which may be constructed of plywood or like material. It will be understood the tubular support braces might also be satisfactorily substituted for those illustrated. Substructure 12 includes longitudinal top brace members 30 interconnected by transverse support braces 32 to form a rectangular top frame. Corner braces 33 which are provided to strengthen the top frame and maintain it in rectangular form, also include holes 27 through which conventional fasteners such as bolts 28 are inserted to hold the plywood decking 18 on the substructure. Side support braces 34 are connected to the ends of top braces 32 and extend diagonally downward toward the inverted apex 36 of triangular side plate 26.

As is best seen in FIG. 5, the inverted apex points of the triangular side plates are transversely connected by a support brace 38 while diagonal transverse support braces 40 and 42 are interconnected between the apex points 36 and upper central transverse support brace 32. Diagonal braces 40 and 42 are pinned centrally at 46 and are further braced near their bottom connections to transverse support 38 by means of corner plates 48 and near their top connections to transverse support 32 by plate 49.

It will be understood that the exact placement of the support braces illustrated in the accompanying drawings is considered to represent only one form of bridge structure suitable for use in the instant invention, and obvious variations in the shape or placement of the bridge support braces are considered to be within the scope of this invention.

Tubular mounting brackets 50 are shown fastened to extend vertically upward from the apex points 36 on the triangular side plates of bridge structure 12 to slidably receive vertical railing posts 52. As shown, posts 52 are bottomed on the crimped portion 53 of bracket 50 and the posts may be secured therein by the tightening down of screw 54 which extends through a threaded hole in the bracket to bear against the railing post. Any conventional railing structure may be used in conjunction with the instant invention so long as its members are relatively light and flexible so as not to unduly resist deformation during minor vertical or torsional flexing of the bridge structure. It will be understood, however, that during a major flex of the platform such as that illustrated in FIG. 8 and discussed hereafter, it is contemplated that the bridge railing will be permanently deformed necessitating replacement. Lightweight aluminum tubes 54 may be mounted in receiving brackets 56 by means of screws or pins 58 or the like inserted through holes in the ends of tubes 54 to provide a satisfactory form of railing. It is also contemplated that pins 58 may be sized to sheer to release the railing 54 from fitting 56 upon application of a predetermined force of a magnitude which would be encountered only during severe bending of the staging, and not during normal operation.

Referring particularly to FIG. 4, the end sections 60 of top railings 54 include a lateral collar 62 welded thereto and sized to slide on tubing 54 to accommodate pivotal movement of the staging 14 with respect to the staging platform. Railing 60 is releasably connected to railing 64 of the vertically movable staging 14 by means of wing nut clamp 66 which allows for rapid disconnection of the staging from the staging platform when bridge sections are added or removed from the platform.

A cable 68 is shown extending through brackets 70 on posts 52 and interconnected by means of toggle bolts to ears 74 mounted on one of the upstanding railings of the staging 14. Lightweight tubing may also be used in place of this cable.

As is best seen in FIG. 2, cable sections 24 are approximately equal in length to longitudinal deck braces 30 and are clamped to substructures 20 at the inverted apexes 36 of the triangular side plates by means of clamps 76 comprising a stamped indentation 77 having a cooperatingly indented closure plate 79 clamped thereto by conventional fasteners to hold swage 81 on cable 24. In one embodiment an ESCO swage No. 402321 has been satisfactorily used on cables 24. In one form of the invention, bolt fasteners 78 ae swaged on the opposite ends of cable 24 to interconnect with compatible fittings such as double ended nut 80 whereby the cables 24 mounted on adjacent bridge sections 12 are interconnected. It is also contemplated that a single cable might be interconnected between the ends of the staging platform rather than the interconnected cable sections, means being provided to lengthen or shorten the cable in response to the addition or removal of bridge sections. The interconnected cables 24 are stretched taut to prevent the interconnected bridge sections from sagging, and if desired, the cables may be tightened to prestress the bridge sections such that the platform bows slightly upwardly.

Referring also to FIG. 7, it will be seen that the swaged on bolts on the outer end of the cables clamped to the end-most bridge sections of a staging platform are interconnected with a curved fitting 82 having a transverse hole 84 in its top portion through which it is pinned by means of nut and bolt connection 86 to end fitting 90 which fitting connects the staging platform to the staging 14 at substantially deck level. Bolt 86 also extends through connecting tab 92, pairs of which are mounted on the triangular side plates 26 adjacent the longitudinal ends of all bridge sections.

As seen in FIG. 6, connecting tabs 92 extend longitudinally outwardly from the corners of the bridge sections and are pinned by conventional nut and bolt means 94 to allow the adjacent bridge sections 12 to pivot in the vertical plane with respect to each other. The connecting tabs 92 on each of the bridge sections are shown to be offset laterally to allow the bridge sections to be easily pinned while maintained in exact longitudinal alignment. It will further be understood that offsetting the connecting tabs allows the bridge sections to be oriented in either longitudinal direction prior to pinning.

Referring again to end connecting bracket 90, it will be seen that this bracket includes an upstanding stop finger 96 which bears against the staging 14 when conventional bolt 100 is inserted through cooperating holes in flanges 102 spaced on either side of railing 104 of the carriage to clamp the staging platform to the staging. Stop finger 96 counteracts the tendency of the stagings 14 to pivot inwardly about the deck level connection when the staging platform is loaded. It will be understood, however, that the connecting bracket 90 illustrated is representative of only one form of bracket suitable for use with the particular type of staging 14 illustrated, and that other types of brackets may be substituted therefor to connect the staging platform to stagings of different design.

In view of all of the above, it will be understood that the disclosed staging platform 10 embodies a uniquely flexible chain-like construction whereby the individual bridge sections 12 are vertically pivotally pinned in the single transverse deck plane, while the flexible interconnected cables 24 resist downward bending of the staging platform under load while allowing the bridge to bend upwardly without permanent deformation or damage when inadvertently lowered onto an obstacle such as 106 as shown in FIG. 8. Should the substructure of any one bridge section be damaged, the entire damaged bridge section may be quickly unclamped and removed from the chain of sections, a new bridge section inserted, or the remaining units simply reconnected to allow work to continue without a major shutdown for repair.

The limitation of the connections between adjacent bridge sections to the pair of laterally spaced pin connections at deck level and the pair of flexible cable connections spaced therebelow, provides a degree of torsional flexibility between each of the bridge sections, particularly as compared to known staging platforms which are commonly rigidly pinned together at a plurality of points on a plurality of spaced planes. FIG. 3 illustrates that the cumulative effect of the small torsional flexibility in each connection may be substantial in a multibridge section platform, thereby allowing the platform to withstand substantial twisting loads without permanent deformation or damage. The use of a chain of bridge sections relatively rigidly interconnected in a single transverse plane at deck level, while flexibly interconnected by means of cables spaced therebelow, provides a staging platform having substantially greater long term durability than presently known rigid stagings of approximately equal size and weight.

In one embodiment of this invention, a 32 foot long staging platform supported by two end mounted staging units was constructed by the interconnection of eight bridge sections each having a length of 4 feet. Each bridge section included aluminum triangular side plates having a thickness of 0.063 inches, a side length at their apex of fourteen inches, and reinforced and interconnected by L-shaped structural supports having ¾ inch flanges which suitably supported a ⅜ inch plywood deck having a length of approximately 4 feet and a width of approximately 2 feet. Cables having a 5/16 inch diameter and a length of approximately 4 feet were clamped to the bottom apex portions of each triangular plate and end connected to like cables on longitudinally adjacent bridge sections.

It will be understood that the invention may be embodied in other specific forms without departing from the spirit or central characteristics thereof. Also, the unique walkway bridge structure of the invention may have other uses besides as a staging platform. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A modular walkway bridge of sectional truss form, comprising:

a plurality of bridge modules interconnected end-to-end, each said bridge module being a section of a truss and including:

an upper peripheral frame of rectangular proportions comprising a pair of elongated side members and a pair of elongated end members;

a panel of sheet material of substantial length and width secured to said upper peripheral frame to both provide an upper deck and stiffen said upper peripheral frame;

a pair of substantially triangular sheet metal side members depending from said upper peripheral frame, each said side member having an upwardly directed base portion connected to the elongated side member of said upper peripheral frame on its side of the bridge module, a downwardly directed generally central apex and a pair of diagonal brace members connected to the ends of said upper peripheral frame and extending therefrom downwardly to said apex, along lower edge portions of said side member;

lateral brace means interconnected laterally between said side members generally at the median plane between said side members; and a pair of laterally spaced apart pin connector means connecting adjacent bridge modules together substantially at deck level, for vertical pivotal movement of each such bridge module relative to the other;

flexible support line means extending longitudinally of the bridge below said bridge modules, to interconnect and support said bridge modules from below, for preventing adjacent bridge modules from pivoting downwardly with respect to each other, said support line means comprising a pair of sectional cables, one on each side of said bridge, each said sectional cable comprising a separate length of cable associated with each bridge module, means connecting each such length of cable to its bridge module, adjacent the apex of the near side member;

wherein said sheet metal side members, said upper peripheral frame, said deck panel, said diagonal brace members, and said lateral brace means give each bridge module a definite rigid form, but together with the structural connections between adjacent bridge modules, comprising the pair of laterally spaced apart pin connector means substantially at deck level and the sectional cable connections spaced therebelow, permit the bridge to twist and to bow upwardly substantial amounts in response to loading, without permanent deformation.

2. A modular walkway bridge according to claim 1, wherein at least one of the bridge modules is an end module and includes mounting means at the outer end thereof, substantially at deck level, for attaching it to a support structure, and wherein each length of sectional cable associated with said end module including an anchor portion which extends from its apex connection endwise outwardly and upwardly to said mounting means, and is affixed to said mounting means and during use of the walkway bridge is in tension.

3. A modular walkway bridge according to claim 1, comprising a tubular socket on each side of each bridge module, positioned at the median of the triangular sheet metal side member on its side of the module, in endwise alignment with the lateral brace means interconnected between said side members, and wherein said modular walkway bridge comprises a railing on each of its sides, said railing including a post insertable into each said socket.

4. A modular walkway bridge of sectional truss form, for interconnection between a pair of laterally spaced apart suspended staging units of a type comprising a deck, protective railing means upstanding from said deck, and a suspension cable extending upwardly from each staging unit to an overhead anchorage station, said bridge comprising:

a plurality of bridge modules interconnected end-to-end, each of said bridge modules being a section of a truss and including:

an upper frame and deck portion of rectangular proportions;

a pair of substantially triangular side members depending from said upper frame and deck portion, along the opposite sides thereof, each said side member having an upwardly directed base portion which is connected to the upper frame and deck portion, and a downwardly directed generally central apex;

lateral brace means interconnected laterally between said side member generally at the median plane between said side members; and a pair of laterally spaced apart pin connector means connecting adjacent bridge modules together substantially at deck level, for vertical pivotal movement of each said bridge module relative to the other;

flexible support line means extending longitudinally of the bridge below said bridge modules, to interconnect and support said bridge modules from below, for preventing adjacent bridge modules from pivoting downwardly with respect to each other and with respect to the staging units, said support lines means comprising a pair of cables, one at each side of said bridge, and means connecting said cables to said bridge module, adjacent the apexes of the side members thereof;

wherein each end bridge module includes mounting means at the outer end thereof, substantially at deck level, for attaching it to the adjacent staging unit, substantially at its deck level, and wherein each cable includes an anchor portion which extends from its apex connection endwise outwardly and upwardly to said mounting means, and is affixed to said mounting means and during use of the walkway bridge is in tension; and wherein said triangular side members, said upper frame and deck portion, and said lateral brace means give each bridge module a definite rigid form, but together with the structural connections between adjacent bridge modules, comprising a pair of laterally spaced apart pin connector means substantially at deck level and the cable connections spaced therebelow, permit the bridge to twist and bow upwardly substantial amounts in response to loading, without permanent deformation, including when the bridge contacts an obstacle when the staging units and bridge are being lowered.

5. A modular walkway bridge according to claim 4, wherein the mounting means at the outer end of each end module includes means preventing the staging units from pivoting inwardly and leaning inwardly relative to said bridge, when the bridge is loaded.

* * * * *